United States Patent [19]

Moriya et al.

[11] 4,027,638

[45] June 7, 1977

[54] EXHAUST GAS RECIRCULATION DEVICE

[75] Inventors: Hisanori Moriya; Tadao Osawa, both of Katsuta, Japan

[73] Assignee: Hitachi, Ltd., Japan

[22] Filed: Jan. 13, 1976

[21] Appl. No.: 648,712

Related U.S. Application Data

[62] Division of Ser. No. 405,899, Oct. 12, 1973.

[30] Foreign Application Priority Data

Oct. 16, 1972 Japan ..... 47-102689

[52] U.S. Cl. ..... 123/119 A
[51] Int. Cl.² ..... F02M 25/06
[58] Field of Search ..... 123/119 A

[56] References Cited

UNITED STATES PATENTS

| | | | |
|---|---|---|---|
| 3,802,402 | 4/1974 | Swatman | 123/119 A |
| 3,882,837 | 5/1975 | Horie et al. | 123/119 A |
| R22,994 | 4/1948 | Bicknell | 123/119 A |
| R27,993 | 4/1974 | Walker | 123/119 A |

FOREIGN PATENTS OR APPLICATIONS

| | | | |
|---|---|---|---|
| 1,601,374 | 4/1970 | Germany | 123/119 A |

*Primary Examiner*—Wendell E. Burns
*Attorney, Agent, or Firm*—Craig and Antonelli

[57] ABSTRACT

An exhaust gas recirculation system whereby a part of exhaust gas is recirculated to the downstream of the carburetor throttle valve through an exhaust recirculation passage for removing the nitrogen oxides in exhaust gas discharged from an internal combustion engine, wherein a pressure control valve is provided in the after-flow of the flow control valve which controls the rate of exhaust gas recirculated to the downstream of the throttle valve disposed halfway in said exhaust recirculation passage, said pressure control valve being arranged such that its opening will be reduced when negative pressure in the downstream of the throttle valve is high and that said opening will be enlarged when said negative pressure is low, whereby the amount of exhaust gas taken into the engine is made basically proportional to the air intake so that the recirculation ratio will be maintained substantially constant over a wide range of operation.

3 Claims, 2 Drawing Figures

EXHAUST GAS RECIRCULATION DEVICE

This is a division of application Ser. No. 405,899 filed Oct. 12, 1973.

This invention relates to an exhaust gas recirculating system for recirculating a part of exhaust gas to the downstream of the carburetor throttle valve through an exhaust recirculation passage for removing the nitrogen oxides contained in exhaust gas released from an automobile engine.

Generally, the exhaust gas recirculation system for re-admitting once released exhaust gas into the engine is roughly divided into two types: one in which exhaust gas is recirculated to the upstream side of the carburetor throttle valve and the other in which exhaust gas is recirculated to the downstream side of said throttle valve, that is, into the intake pipe. However, the former type, although effective in controlling recirculation rate, has the problems over contamination of the carburetor, heat resistance and other matters. While the latter type, although including an already mass-produced system in which recirculation rate is controlled by operating a diaphragm valve with negative pressure in the upstream of the carburetor throttle valve, has a drawback that the recirculation ratio $$\left(\frac{\text{exhaust gas recirculation rate}}{\text{air intake}}\right)$$

varies as the rotational frequency changes at a constant throttle valve opening.

There is also known a system in which the recirculation rate is controlled by a link mechanism interlocked with the throttle valve, but this system involves the problems in operatability, durability and installation.

An object of the present invention is to provide an exhaust gas recirculation system whereby it is possible to obtain a substantially constant recirculation ratio basically proportional to the air intake over a wide range of operation.

Another object of the present invention is to provide an exhaust gas recirculation system of the type just recited, which is compact in structure and has high durability.

Features of the Invention

A salient feature of the present invention is that a pressure control valve is provided in the after-flow of an exhaust recirculation rate controlling valve disposed halfway in an exhaust recirculation passage communicating the downstream of the carburetor throttle valve with an exhaust pipe, said pressure control valve being arranged such that its opening will be enlarged when negative pressure in the downstream of the throttle valve is low and that said opening will be reduced when said negative pressure is high, whereby the recirculation ratio of exhaust gas taken into the engine is made basically proportional to the air intake and maintained substantially constant over a wide range of operation.

Figure 1:
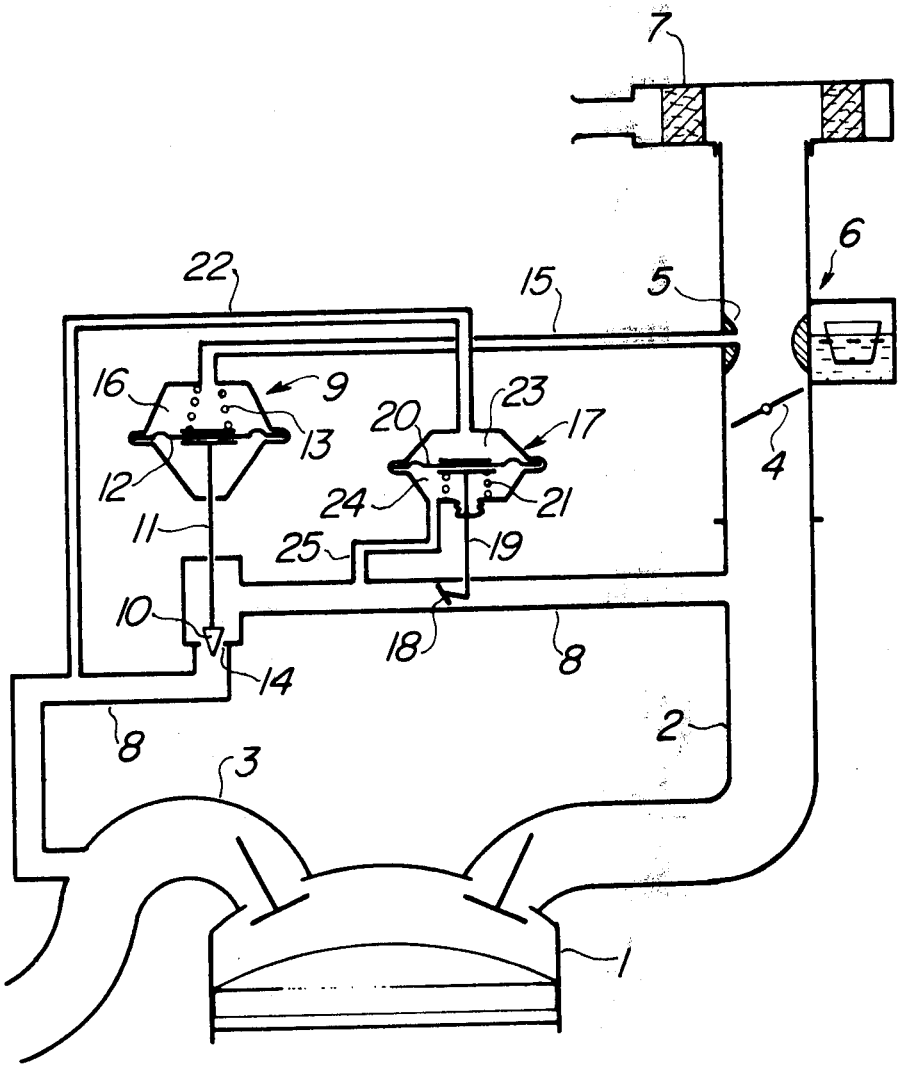
Figure 2:
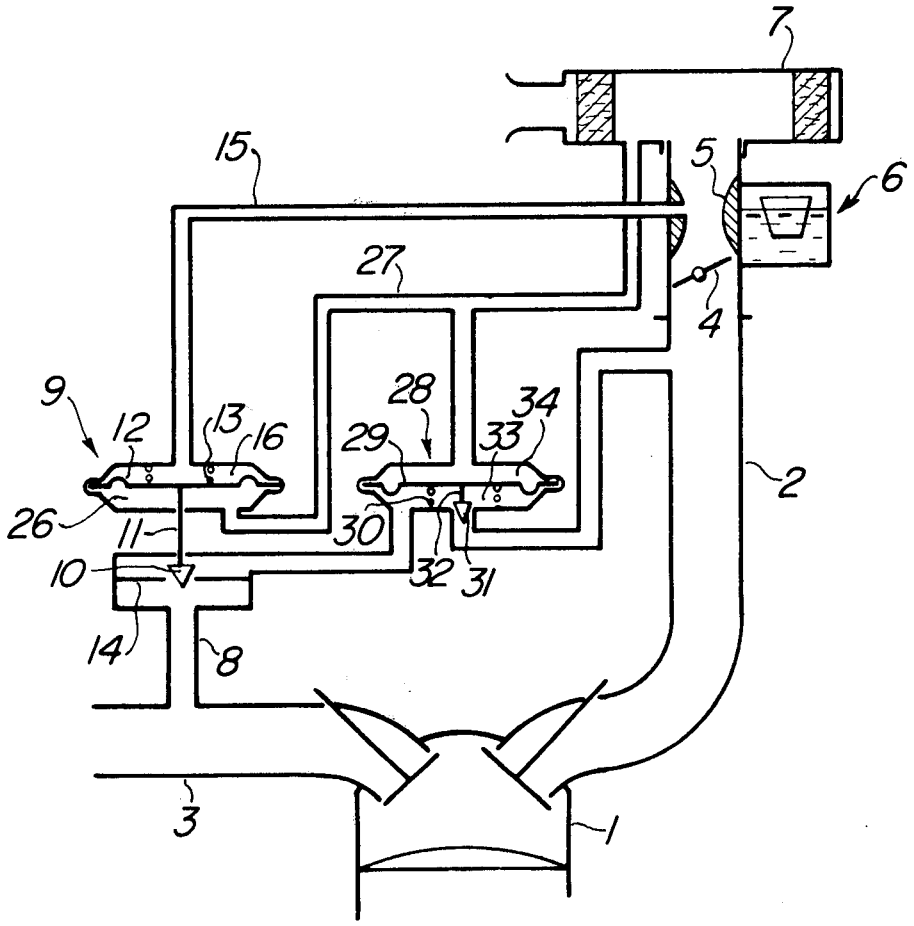

FIG. 1 is an arrangement plan of the exhaust gas recirculation system according to an embodiment of the present invention; and FIG. 2 is an arrangement plan of the system according to another embodiment of the present invention.

Now, an embodiment of the present invention is described in particulars with reference to FIG. 1.

Numeral 1 in the figure designates generally an engine body having an intake pipe 2 and an exhaust pipe 3. The intake pipe 2 is communicated with the atmosphere through a carburetor 6, which comprises a throttle valve 4 and a Venturi 5, and an air cleaner 7. Air introduced through said air cleaner 7 is mixed with fuel fed through the carburetor 6, and the mixture is supplied into the engine 1 through the intake pipe 2. Numeral 8 indicates an exhaust circulation passage which connects said exhaust pipe 3 and intake pipe 2 so that exhaust gas from said exhaust pipe 3 will be recirculated into the intake pipe 2. Numeral 9 refers generally to a flow control unit comprising a flow control valve 10, a rod 11, a diaphragm 12 and a diaphragm spring 13. Said flow control valve 10 and diaphragm 12 are connected to each other through rod 11. Said flow control valve 10 is adapted to open or close the measuring orifice 14 to measure the flow rate of exhaust gas. Venturi 5 is connected to a negative pressure chamber 16 in siad flow control unit 9 through a negative pressure passage 15. Disposed in said negative pressure chamber 16 is a diaphragm spring 13 which is arranged to constantly urge said flow control valve 10 into its closed position. Numeral 17 designates generally a pressure control unit comprising a pressure control valve 18, a rod 19, a diaphragm 20 and a diaphragm spring 21. Said pressure control valve 18 is provided in exhaust recirculation passage 8 and connected to diaphragm 20 through rod 19. 22 is a first pressure releasing passage connecting the upstream of flow control unit 9 and a first pressure releasing chamber 23 in said pressure control unit 17. There is also provided in siad pressure control unit 17 a second pressure releasing chamber 24 which is partitioned from said first pressure releasing chamber 23 by diaphragm 20. Said second pressure releasing chamber 24 is connected through second pressure releasing passage 25 to a halfway part of exhaust recirculation passage 8 between said flow control valve 10 and pressure control valve 18.

In operation of the system, in case there exists a large pressure difference between both sides of flow control unit 9 and flow control valve 10, diaphragm 20 in pressure control unit 17 is urged to move downwardly in FIG. 1 by overwhelming the opposed force of diaphragm spring 21, actuating rod 19 to let pressure control valve 18 move to its closed position. When this occurs, pressure between the measuring section comprising flow control valve 10 and measuring orifice 14 in said flow control unit 9 and pressure control valve 18 in pressure control unit 17 is raised to lessen the pressure difference between both sides of said measuring orifice 14. On the other hand, when the pressure difference between both sides of said measuring orifice 14 is small, diaphragm 20 is pushed upwardly in FIG. 1 by diaphragm spring 21 in said pressure control unit 17 to open pressure control valve 18 so as to enlarge the pressure difference between both sides of said measuring orifice 14. Thus, by suitably selecting the strength of diaphragm spring 21 through repetition of the above operations, it is possible to keep substantially constant the pressure difference between both sides of the measuring mechanism constituted from flow control valve 10 and measuring orifice 14 in flow control unit 9.

With the pressure difference between both sides of measuring orifice 14 in said flow control unit 9 being adjusted constant by the above-said arrangements, if the measuring area determined by said measuring orifice 14 and flow control valve 10 is arranged to be basically proportional to the air intake, the recirculation ratio becomes substantially constant, as expressed by the following formula (1):

$$\alpha = \frac{C \cdot A \sqrt{Pe - Pc}}{Qa} \quad (1)$$

$\alpha$: recirculation ratio
*C:* constant
*A:* measuring area determined by measuring orifice 14 and flow control valve 10
*Pe:* pressure (released pressure) in the upstream of measuring orifice 14
*Pc:* pressure between measuring orifice 14 and pressure control valve 18
*Qa:* air intake The embodiment shown in FIG. 1 utilizes negative pressure in the Venturi for detecting the air intake. That is, in this embodiment, flow control valve 10 which controls the opening of measuring orifice 14 is secured to diaphragm 12, and when the air intake is increased to raise the Venturi negative pressure, said flow control valve 10 is displaced upwardly in FIG. 1 by overwhelming the resisting force of diaphragm spring 13, thereby to increase the measuring area.

In this way, it is possible to control the recirculation rate basically proportional to the air intake, regardless of the operating conditions, through combination of a pressure control unit and a flow control unit. The entire system is also very simple. Although in the embodiment of FIG. 1 a butterfly valve is used as pressure control valve, it may be replaced with a poppet type or a pintle type valve. In case where it is impossible to enlarge the diaphragm in the flow control unit, it needs to incorporate a simple pressure amplifying means because the Venturi negative pressure signal is very small. Also, the flow control valve may be operated electrically by detecting the engine speed, carburetor throttle valve opening and intake negative pressure.

Referring now to FIG. 2, there is shown another embodiment of the present invention where arrangement is made such as to keep substantially constant the intake pipe negative pressure applied to the flow control valve, thereby to obtain a substantially constant recirculation ration which is basically proportional to the air intake over a wide range of operation. In FIG. 2, same reference numerals are used to designate the same parts as in FIG. 1. That is, numeral 1 designates the engine body having an intake pipe 2 and an exhaust pipe 3. Numeral 6 denotes a carburetor comprising a throttle valve 4 and a Venturi 5, and 8 is an exhaust recirculation passage provided in its way with a flow control unit 9 which comprises a diaphragm 12, a diaphragm spring 13 and a flow control valve 10 secured to said diaphragm 12 through a rod 11. Said flow control valve 10 is adapted to open or close a measuring orifice 14 to measure the ecxhaust gas rate. Said Venturi 5 is connected through a passage 15 to a negative pressure chamber 16 in said flow control unit 9. In said negative pressure chamber 16 is disposed said diaphragm spring 13 adapted to constantly urge said flow control valve 10 into its closed position. On the opposite side of diaphragm 12 from said negative pressure chamber 16 is provided an air cleaner chamber 26 which is connected through an air cleaner passage 27 to the upstrem of the carburetor 6, that is, to the air cleaner 7 in the shown embodiment. Flow control valve 10 is controlled by the difference between Venturi negative pressure introduced from negative pressure passage 15 and pressure form said air cleaner 7. Numeral 28 designates a pressure control unit comprising a diaphragm 29, a diaphragm spring 30 and a pressure control valve 31. Said pressure control valve 31 is connected to diaphragm 29 through a rod 32. Said diaphragm spring 30 is disposed in a first control chamber 33 and adapted to constantly urge said pressure control valve 31 into its open position. Said first control chamber 33 is designed to serve concurrently as an exhaust recirculation passage. Numeral 34 refers to a second control chamber provided in pressure control unit 28 and arranged such that pressure from air cleaner 7 will be guided thereinto. Pressure control valve 31 is adapted to control at a constant level the pressure applied to flow control valve 10 and measuring orifice 14 in flow control unit 9 by balancing of the throttle valve downstream side negative pressure guided from exhaust recirculation passage 8 and acting to diaphragm spring 30 and first control chamber 33 and pressure from air cleaner 7 acting to second control chamber 34. Said pressure control unit 28 operates such that when the throttle valve opening is small, it forces down (in FIG. 2) the pressure control valve 31 in said control unit 28 to lower to a prescribed level the negative pressure acting to flow control valve 10 and measuring orifice 14 through exhaust recirculation passage 8. During this time, the measuring area formed by flow control valve 10 and measuring orifice 14 in flow control unit 9 is small and hence the recirculation rate is low. During the high speed operation, pressure control valve 31 in pressure control unit 28 is directed upwardly in FIG. 2, raising the negative pressure applied to flow control valve 10 and measuring orifice 14 up to a substantially same level as when the throttle valve opening is small. At this time, the measuring area formed from measuring orifice 14 and flow control valve 10 is enlarged.

In this way, pressure control unit 28 operates to lower to a set value the negative pressure applied to measuring orifice 14 and flow control valve 10 when the throttle valve opening is small, while said negative pressure is raised to a same level as at the time of small throttle valve opening when such throttle valve opening is enlarged, thereby always keeping substantially constant the negative pressure acting to said measuring orifice 14 and flow control valve 10.

Assuming that the pressure (constant) controlled by said pressure control unit 28 is P*re*, then the pressure P*e* in exhaust pipe 3 is given by the following equation:

$$Pe = K \cdot Qa^2 \quad (2)$$

where $K$ is a constant and $Qa$ is air intake.

From this, the exhaust gas rate Q*r*is determined as follows:

$$Qr = F \cdot A \sqrt{\frac{2g}{\gamma}(Pe - Pre)} \quad (3)$$

$$= F \cdot A \sqrt{\frac{2g}{\gamma}(K \cdot Qa^2 - Pre)} \quad (4)$$

*F*: flow coefficient of flow control valve 10

$A$: measuring area determined from flow control valve 10 and measuring orifice 14

$g$: gravitational acceleration $\gamma$: specific weight of exhaust gas

Here, the flow coefficient of flow control valve 10, gravitational acceleration and specific weight of exhaust gas are all substantially constant values.

Formula (4) above can be rewritten as follows:

$$A = \frac{Qr}{F \cdot \sqrt{\frac{2g}{\gamma}(K \cdot Qa^2 - Pre)}} \quad (5)$$

Here, $Qr = \alpha Qa$ ($\alpha$:recirculation ratio), hence:

$$A = \frac{\alpha Qa}{F \cdot \sqrt{\frac{2g}{\gamma}(K \cdot Qa^2 - Pre)}} \quad (6)$$

Then, the stroke S of flow control valve 10 in flow control unit 9 is given by:

$$S = H \cdot Qa^2 \quad (7)$$

$H$: coefficient of stroke

Thus, if the air intake $Qa$ is determined from the formulae (6) and (7), the stroke S of flow control valve 10 is given, and accordingly, the required measuring area is determined from the measuring orifice 14. Therefore, in case the pressure $Pre$ controlled by pressure control unit 28 is a relatively high negative pressure, there is required a valve having a configuration that satisfies the formulae (6) and (7), and its stroke control can be accomplished by adjustment of Venturi negative pressure. Also, if Pre is controlled to a value close to the atmospheric pressure, the measuring area determined from the flow control valve and measuring orifice becomes substantially constant, thus allowing practical control with a fixed orifice.

What we claim is:

1. An exhaust gas recirculation device for recirculating a part of exhaust gas discharged from the exhaust system to the downstream of the carburetor throttle valve through an exhaust recirculation passage for removing nitrogen oxides released from an internal combustion engine, characterized in that a pressure control valve is provided in the afterflow of a flow control valve disposed halfway in said exhaust recirculation passage for controlling the amount of exhaust gas recirculated to the downstream of said throttle valve, said pressure control valve being controlled such that its opening will be reduced when the negative pressure downstream of the throttle valve is high and that said opening will be enlarged when said negative pressure is low, means for operating the flow control valve by a signal proportional to air intake, wherein said flow control valve is controlled by negative pressure in the Venturi in the carburetor, and said pressure control valve is controlled by the difference between the pressure in the upstream of the flow control valve and the pressure between said pressure control valve and said flow valve.

2. In an internal combustion engine comprising carburetor means, a Venturi, and a throttle valve downstream of said carburetor means, intake passage means connected with said carburetor means for conducting an air-fuel mixture into the engine, and exhaust passage means for conducting exhaust gas from the engine, the improvement comprising an exhaust gas recirculation means for removing nitrogen oxides from the engine exhaust gases including exhaust gas recirculation passage means for recirculating a portion of the exhaust gas from said exhaust passage means to said intake passage means downstream of said throttle valve; flow control valve means in said exhaust gas recirculation passage means and operative in response to a signal of negative pressure corresponding to the suction air quantity in said carburetor means for controlling the flow rate of the recirculated exhaust gas; and pressure control valve means in said gas exhaust recirculation passage means downstream of said flow control valve means and operative in response to a pressure difference between the upstream side and the downstream side of said flow control valve means for keeping substantially constant the pressure difference between the upstream side and the downstream side of said flow control valve means.

3. In an internal combustion engine with an exhaust gas recirculation means in accordance with claim 2, further including means for operating said flow control valve means in response to negative pressure in the Venturi.

* * * * *